United States Patent [19]

Sergovic

[11] 4,031,289

[45] June 21, 1977

[54] STAIN RESISTANT POLYESTER-COATED BLOCK

[75] Inventor: John A. Sergovic, Severna Park, Md.

[73] Assignee: The Burns & Russell Company of Baltimore City, Baltimore, Md.

[22] Filed: May 11, 1976

[21] Appl. No.: 685,254

[52] U.S. Cl. ..... 428/451; 428/331; 428/404; 428/405; 428/446; 428/447; 428/454; 428/480; 428/482; 428/920; 428/921; 260/40 R; 260/42.15; 260/861; 52/612; 52/309.3

[51] Int. Cl.[2] ..... B32B 13/12; B32B 5/16; B32B 27/36

[58] Field of Search ..... 428/451, 454, 331, 447, 428/921, 920, 407, 405, 308, 404, 446, 480, 482; 260/40 R, 42.15, 861; 52/309, 612

[56] References Cited

UNITED STATES PATENTS

| | | | |
|---|---|---|---|
| 2,751,775 | 6/1956 | Sergovic | 428/451 |
| 2,817,619 | 12/1957 | Bickel | 428/451 |
| 3,328,231 | 6/1967 | Sergovic | 428/451 |
| 3,345,339 | 10/1967 | Parker | 260/75 UA |
| 3,632,725 | 1/1972 | Jones | 428/451 |

*Primary Examiner*—Ellis Robinson
*Attorney, Agent, or Firm*—Cushman, Darby & Cushman

[57] ABSTRACT

Masonry blocks are provided with a cured resinous coating of an ethylenically-unsaturated polyester. The polyhydric alcohol in the ester is primarily neopentyl glycol to provide water resistance. The acid in the ester is isophthalic acid with 10 to 33% maleic anhydride, based on the total weight of the polyester. If the upper limit on the maleic anhydride is exceeded, stain resistance is lost. Triethyl phosphate is preferably incorporated to provide fire resistance while eliminating flame and smoke problems when employing methyl methacrylate as a polymerizable solvent. The sand-polyester compositions of the invention can also be formed as cast articles without a masonry unit backing.

32 Claims, 2 Drawing Figures

STAIN RESISTANT POLYESTER-COATED BLOCK

BACKGROUND OF THE INVENTION

This invention relates to coated masonry building units, coating compositions therefor, unsaturated polyester resins, and the method of producing the coated masonry building units with a facing or coating that will be both stain-resistant and resistant to discoloration (blushing) when subjected to high moisture conditions for long periods.

There are disclosed in my prior patents:

a. U.S. Pat. No. 2,751,775, issued June 26, 1956 — a coated masonry building block made of a cured composition of an unsaturated polyester resin and sand in which the sand comprises at least 50% by weight of the coating composition. The unsaturated polyester resin is derived from a reaction between a dicarboxylic acid, e.g., phthalic, maleic, fumaric, adipic, pimelic, suberic, sebacic, itaconic, citraconic and succinic acids and their anhydrides and a polyhydric alcohol, e.g., ethylene glycol, diethylene glycol, and propylene glycol.

b. U.S. Pat. No. 3,328,231, issued June 27, 1967 — a coated masonry building block made of a cured composition of an unsaturated polyester resin as described in U.S. Pat. No. 2,751,775, and a sand, surface-treated with an silane or siloxane having the general formula:

$$R_xSiX_{(4-x)}$$

in which at least one R is an unsaturated group, preferably an unsaturated hydrocarbon group, e.g., an alkenyl, haloalkenyl or alkadienyl group, including dienyl, vinyl, chlorvinyl, bivinyl, allyl, methallyl, chlorallyl, and the like; X is a group which reacts with the hydroxyl groups present in sand or moisture normally present in the surface of sand such as, preferably, chlorine or bromine, although it may be oxyaryl, oxyalkyl, amino, etc.; $x$ is a whole number from 1 to 3. If more than one R group is present, the remaining R groups can be hydrocarbyl, e.g., alkyl, such as methyl or ethyl or aryl, e.g., phenyl. Examples of these compounds are:

allyl triethoxy silane
diallyl diethoxy silane
triallyl ethoxy silane
methallyl trichloro silane
trichloroallyl chloro silane
allylphenyl dichloro silane
allylethyl dichloro silane
allylmethyl diethoxy silane
diallylmethyl ethoxy silane
allyl trichloro silane
dimethallyl diethoxy silane
vinyl trichloro silane
divinyl dichloro silane
trivinyl monochloro silane
vinyl triethoxy silane
methyl vinyl dichloro silane in which the sand comprises at least 50% by weight of the coating composition.

The entire disclosures of U.S. Pat. Nos. 2,751,775 and 3,328,231 are hereby incorporated by reference and relied upon.

The coated masonry building units disclosed in said patents have surfaces that resemble ceramic tile finishes, yet have superior physical properties such as better mechanical strength, craze resistance, color uniformity, and resistance to staining.

These surfaces, while highly impervious to moisture, have been found to become discolored, whiten, when subject to long periods of storage in unprotected areas such as construction sites. This whitening (blushing) is the result of moisture absorption by the cured resin used in the facing composition.

SUMMARY OF THE INVENTION

It is the object of the present invention to provide a process for eliminating the discoloration tendency of the building unit surfaces without loss of the other desirable physical properties, i.e.:

resistance to mechanical damage
resistance to cracking and crazing
resistance to temperature change
maintenance of color uniformity and, in particular, resistance to the staining obtained through the teachings in my U.S. Pat. No. 3,328,231.

The present invention is a result of an intensive research investigation. When it was discovered that the facings of the cured composition consisting of a polyester resin and a silane surface-treated sand, in accordance with U.S. Pat. Nos. 2,751,775 and 3,328,231, tended to whiten after long exposures to high moisture conditions, attempts were made to eliminate the whitening (blushing) by changing the chemical characteristics of the unsaturated polyester resin. Changes in the reactivity of the resin, through variations of acid number, produced no improvement. Variations in the portions of the ethylene, diethylene and propylene glycols also failed to solve the blushing problem.

In the course of this research investigation, it becomes increasingly apparent that the polyhydric alcohols used in the manufacture of the polyester resin were the cause of the lack of resistance to moisture deterioration. It was concluded that a totally different polyhydric alcohol was needed. In the course of this research, it was discovered that a specific polyhydric alcohol, namely, neopentyl glycol (2.2.dimethyl-1,3-propanediol), when used to make the unsaturated polyester, resulted in a cured facing composition that was resistant to whitening (blushing) under the most severe conditions. It was further discovered that best results were obtained by using only neopentyl glycol as the polyhydric alcohol, although small replacements of neopentyl glycol by propylene glycol and/or ethylene glycol resulted in satisfactory resistance to discoloration due to this moisture absorption.

Although the improvement in resistance to whitening (blushing) was accomplished through the use of neopentyl glycol, in the course of this research, it was found that the stain resistance normally obtained through the teachings of U.S. Pat. No. 2,751,775 and U.S. Pat. No. 3,328,231, were completely lost.

Obviously, the loss of stain resistance could not be tolerated, hence, further research work was conducted. This research resulted in the discovery that an unsaturated polyester resin made primarily from neopentyl glycol for moisture resistance can be combined with a silane surface-treated sand to produce a cured composition for a facing for a masonry unit that is stain-resistant, providing that dicarboxylic acid portion of the polyester resin contains 33% or less of maleic anhydride based on the total weight of the finished resin.

While not being limited to any theory, it appears that in the case of a neopentyl glycol type, unsaturated polyester resin maleic anhydride contents higher than 33% causes the bonding or coupling action between the resin and the surface-treated sand grains, as described in my U.S. Pat. No. 3,328,231, to be disrupted.

The unsaturated polyester resins used for producing the coating composition for coated masonry building units are made by reacting a dicarboxylic acid with a polyhydric alcohol in a manner that is familiar to resin chemists.

The preferred resin of this class for employment in the curing composition of this invention is made from the following materials in the quantities shown below:

| | Resin Formulation A | |
|---|---|---|
| | Mols | % Maleic Anhydride in Finished Resin |
| Neopentyl Glycol | 1.02 | |
| Isophthalic Acid | 0.5 | |
| Maleic Anhydride | 0.5 | 23.2% |

Another resin of this class that produced a cured composition with just passable stain resistance and resistance to moisture discoloration (blushing) is made from the following materials:

| | Resin Formulation B | |
|---|---|---|
| | Mols | % Maleic Anhydride in Finished Resin |
| Propylene Glycol | 0.46 | |
| Neopentyl Glycol | 0.64 | |
| Isophthalic Acid | 0.33 | |
| Maleic Anhydride | 0.67 | 33.2% |

Another resin of this class that produced a cured composition that failed to resist staining, yet did not whiten when subject to high moisture exposure, is made from the following materials:

| | Resin Formulation C | |
|---|---|---|
| | Mols | % Maleic Anhydride in Finished Resin |
| Propylene Glycol | 0.29 | |
| Neopentyl Glycol | 0.72 | |
| Isophthalic Acid | 0.29 | |
| Maleic Anhydride | 0.71 | 36.3% |

In the course of this research, as seen from the above information, it was discovered that the maleic anhydride content of the resin used for making curing facing compositions having resistance to staining is critical; the maximum being 33%.

The resistance to staining was determined by testing in accordance with Sections 3.2.4.8; 4.4.2.8.1 and 3.2.4.8.2 of Federal Specification SS-C621b, Jan. 19, 1968, including Interim Amendment 2 of June 18, 1970, wherein the cured facing of a masonry building unit is subjected to blue-black ink for 1 hour and oil-soluble dye-staining media for four days.

While preferably neopentyl glycol is the sole polyhydric alcohol, almost as good results can be obtained with a mixture containing propylene glycol in an amount of not over 10% of the total moles of glycol (i.e., at least 90 mole % of the glycol is neopentyl glycol). It is possible to employ as little as 58 mole % neopentyl glycol with 42 mole % propylene glycol based on the total polyhydric alcohol but the water resistance begins to get lost. Less preferably, ethylene glycol and diethylene glycol can be substituted for all or part of the propylene glycol.

The maleic anhydride, as stated, should be such that 10 to 33% of the weight of the polyester resin is made from the maleic anhydride. Preferably, the amount of maleic anhydride is not over 30% since staining begins to be barely visible above this limit. Below 10% maleic anhydride, there are insufficient unsaturated groups in the polyester for reaction with the polymerizable solvent.

The other acid employed in forming the polyester resin is isophthalic acid. It is critical to use isophthalic acid. Thus, employing phthalic anhydride or o-phthalic acid results in the loss of water resistance.

The mole ratio of total alcohol to total acid is approximately the theoretical one of 1:1. Preferably, a slight excess of glycol, e.g., a 2% molar excess, is employed.

As is conventional in making unsaturated polyesters, they are cut with polymerizable solvents in an amount sufficient to make the uncured composition liquid when applied to the masonry unit. There can be employed, for example, 30 to 45%, or even up to 55%, of the polymerizable solvent. The preferred polymerizable solvents are styrene and methyl methacrylate. However, there can be used other polymerizable solvents such as those mentioned in my prior U.S. Pat. Nos. 2,751,775 and 2,328,231, e.g., p-methyl styrene, vinyl acetate, diallyl phthalate, cyclopentadiene, ethyl acrylate.

When employing methyl methacrylate, it has been found desirable to incorporate triethyl phosphate as a fire retardant and as a diluent to reduce the viscosity. The triethyl phosphate eliminates both flame and smoke. It is critical to use triethyl phosphate since tricresyl phosphate is not satisfactory for use when methyl methacrylate is employed as the polymerizable solvent. When employing styrene as the polymerizable solvent, there are employed conventional chlorinated hydrocarbon fire retardants since triethyl phosphate is unsuitable.

While it is preferred to have the fire retardants present, this is not an essential feature of the invention in its broader aspects.

The amount of sand employed is that conventional in this art and is usually about 50 to 90% of the total of polyester resin, polymerizable monomer and filler, by weight.

There can be employed conventional peroxygen catalysts as curing agents for the unsaturated polyester, e.g., benzoyl peroxide, methyl ethyl ketone peroxide, t-butyl perbenzoate, t-butyl peroctoate, and 2,5-dimethyl-2,5-bis(2-ethylhexanoylperoxy) hexane (available as U.S. Peroxygen Catalyst 245). The amount of catalyst is not critical and, as is conventional, is usually between 0.5 and 2% of the total weight of the unsaturated polyester and polymerizable solvent.

The coated masonry units, e.g., blocks, are suitable for use both for exterior and interior purposes, e.g., for the exterior walls of houses, apartments, office buildings, and industrial plants, and as interior structures, e.g., for bathroom walls, decorative fireplace walls, room dividers, etc.

The invention will be understood best in connection with the drawings wherein:

BRIEF DESCRIPTION OF THE INVENTION

FIG. 1 is a perspective view of a coated block employing three different polyester formulations; and FIG. 2 is a fragmentary vertical sectional view of a block coating according to the invention.

Referring more specifically to FIG. 1, a masonry block 4 was coated with three different vinyl tris(2-methoxyethoxy)silane-treated sand-filled polyester compositions in the respective areas 4, 6 and 8, and the coatings cured. All of the polyester compositions were made from neopentyl glycol, isophthalic acid and maleic anhydride using methyl methacrylate as the polymerizable solvents. In area 4, the polyester contained 23.2% maleic anhydride. In area 8, the polyester contained 33% maleic anhydride, and, in area 6, the polyester contained 36% maleic anhydride. In the circular areas 10, 12 and 14, within areas 4, 6 and 8, there was applied blue-black ink for one hour and the stain then treated in the manner set forth in Federal Specification SS C-621*b* with the amendment of June 18, 1970. As can be seen from FIG. 1, in area 10, none of the stain is visible after the cleaning; in area 12, a substantial amount of the stain remained; and, in area 14, the stain was slightly visible.

In FIG. 2, the numeral 20 indicates the block, and 22, the cured vinyl tris(2-methoxyethoxy) silane-treated sandfilled neopentyl glycol, isophthalic acid, maleic acid polyester facing layer 22. The maleic anhydride was 23% of the polyester. As polymerizable solvent, there was employed styrene prior to applying the sand-filled polyester to the block.

Unless otherwise indicated, all parts and percentages are by weight.

DETAILED DESCRIPTION

Figure 1:
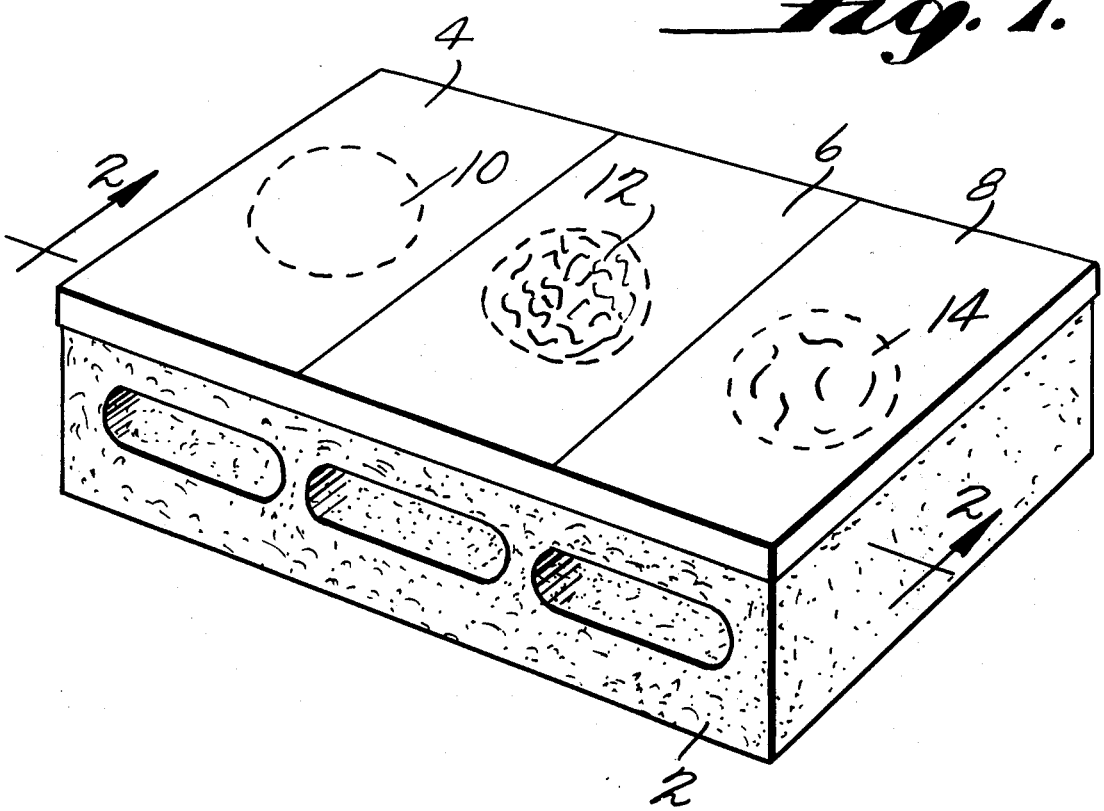
Figure 2:
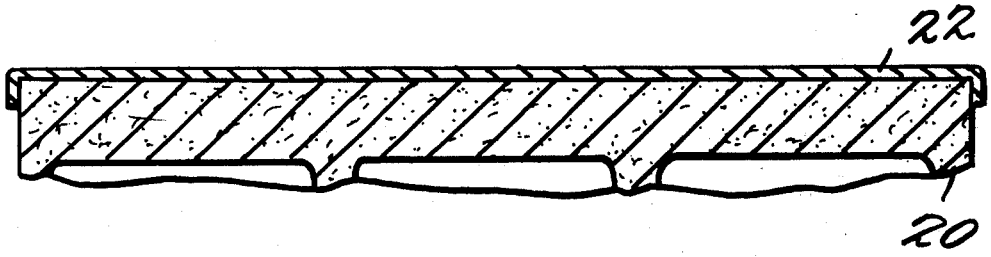

In order to more clearly disclose the nature of the present invention, specific examples are set forth hereinafter:

To demonstrate the teaching of this invention, three basic materials were prepared:

a. Sand Mixture
b. Polyester Resin
c. Pigmented Compound as will be described below:

EXAMPLE I

A surface-treated sand mixture was first prepared by mixing:

200 lbs. — Silica Sand (approximate sieve analysis) —
30% on No. 70 Mesh U.S. Sieve
40% on No. 100 Mesh U.S. Sieve
20% on No. 140 Mesh U.S. Sieve
10% through No. 140 Mesh U.S. Sieve 800 lbs. — Silica Sand (approximate U.S. Sieve analysis) —
5% on No. 30 Mesh U.S. Sieve
75% on No. 40 Mesh U.S. Sieve
20% on No. 50 Mesh U.S. Sieve To this sand mixture was added 0.05% by weight of vinyl-tris (2-methoxyethoxy) silane $CH_2{=}CH\ Si\ (OC_2H_4OCH_3)_3$. After thorough blending, the mass was heated to 150° F. to effect hydrolysis of the silane. This surface-treated sand will be referred to as Sand Blend No. 1.

An unsaturated polyester resin was made by heating in appropriate resin-making apparatus a mixture of:

| Ingredient | Mols | Molecular Weight | Pounds Per Batch |
|---|---|---|---|
| Neopentyl Glycol | 1.02 | 104 | 106.0 |
| Isophthalic Acid | 0.5 | 166 | 83.0 |
| Maleic Anhydride | 0.5 | 98 | 49.0 |

-continued

| Ingredient | Mols | Molecular Weight | Pounds Per Batch |
|---|---|---|---|
| | | | 238.0 |

The resultant resin had a maleic anhydride content of 23.2% and acid value of 20 (based on solid resin). It was reduced with styrene to make a resin solution containing 55% polyester resin and 45% styrene. This resin solution will be referred to as Resin "A".

A pigmented Compound No. 1 was prepared from Resin "A" according to the following:

| Ingredients | Amount |
|---|---|
| Resin A | 760 |
| Styrene | 38 |
| Chlorinated Paraffin (70% Chlorine) | 28 |
| National Lead Oncor 75 (25% Antimony Trioxide - 75% $SiO_2$) | 15 |
| Dow Anti Foam A (a silicone anti-foaming agent) | 2 |
| Titanium Dioxide | 12 |
| Asbestine | 145 |

by thoroughly mixing the above ingredients in a paint-making blender.

From the previously-prepared materials, a coating composition was prepared as follows:

| Ingredients | Amount |
|---|---|
| Pigmented Compound No. 1 | 710 lbs. |
| Methyl methacrylate | 248 |
| Triethyl Phosphate | 106 |
| U.S. Peroxygen Catalyst No. 245 | 8 |
| Aluminum Trihydrate | 144 |
| Sand Blend No. 1 | 3620 |

After thorough mixing, the composition was placed into a mold and distributed to a uniform thickness of approximately 3/16 inch. A concrete block was placed into the mold on top of the coating composition. The mold, with coating composition and concrete block, was then placed in a curing oven, wherein the temperature of the coating composition was raised from 260° to 300° F. in 15 minutes to effect cure of the facing. The curing caused the facing to become solid and firmly anchored to the surface of the concrete block. The coated block was then removed from the mold and found to have a smooth decorative facing having excellent resistance both to staining and discoloration (blushing) due to moisture.

EXAMPLE II

An unsaturated polyester resin was made by heating in an appropriate resin-making apparatus a mixture of:

| Ingredient | Mols | Molecular Weight | Pounds Per Batch |
|---|---|---|---|
| Propylene Glycol | 0.46 | 76 | 39.96 |
| Neopentyl Glycol | 0.64 | 104 | 66.67 |
| Isophthalic Acid | 0.33 | 166 | 54.78 |
| Maleic Anhydride | 0.67 | 98 | 65.66 |
| | | | 221.96 |

The resultant resin had a maleic anhydride content of 33.0% and an acid value of 16 (based on solid resin). It was reduced with styrene to make a resin solution containing 55% polyester resin and 45% styrene. This resin solution will be referred to as Resin "B".

From the previously-prepared materials, a pigment Compound No. 2 was prepared as follows:

| Ingredients | Amount |
|---|---|
| Resin B | 760 |
| Styrene | 38 |
| Chlorinated Paraffin (70% chlorine) | 28 |
| National Lead Oncor 75 (25% Antimony Trioxide - 75% $SiO_2$) | 15 |
| Dow Anti Foam A | 2 |
| Titanium Dioxide | 12 |
| Asbestine | 145 |

by thoroughly mixing the above ingredients in a paint-making blender.

From the previously-prepared materials, a coating composition was prepared as follows:

| Ingredients | Amount |
|---|---|
| Pigmented Compound No. 2 | 710 lbs. |
| Methyl Methacrylate | 248 |
| Triethyl Phosphate | 106 |
| U.S. Peroxygen Catalyst No. 245 | 8 |
| Aluminum Trihydrate | 144 |
| Sand Blend No. 1 | 3620 |

Following the exposure described in Example I, a coated block was produced that passed suitable resistance to staining and discoloration (blushing) due to moisture.

EXAMPLE III (COMPARISON EXAMPLE)

An unsaturated polyester resin was made by heating in an appropriate resin-making apparatus a mixture of:

| Ingredient | Mols | Molecular Weight | Pounds Per Batch |
|---|---|---|---|
| Propylene Glycol | 0.29 | 76 | 22.04 |
| Neopentyl Glycol | 0.72 | 104 | 74.88 |
| Isophthalic Acid | 0.29 | 166 | 48.14 |
| Maleic Anhydride | 0.71 | 98 | 69.58 |
| | | | 214.64 |

The resultant resin had a maleic anhydride content of 35.4% and an acid number of 14 (based on solid resin); this resin was reduced with styrene to make a solution containing 55% polyester resin and 45% styrene. This resin solution will be referred to as Resin "C".

A pigmented Compound No. 3 was prepared as follows:

| Ingredients | Amount |
|---|---|
| Resin C | 760 |
| Styrene | 38 |
| Chlorinated Paraffin (70% Chlorine) | 28 |
| National Lead Oncor 75 (25% Antimony Trioxide - 75% $SiO_2$) | 15 |
| Dow Anti Foam A | 2 |
| Titanium Dioxide | 12 |
| Asbestine | 145 |

by thoroughly mixing the above ingredients in a paint-making blender.

From the previously-prepared materials, a coating composition was prepared as follows:

| Ingredients | Amount |
|---|---|
| Pigmented Compound No. 3 | 710 lbs. |
| Methyl Methacrylate | 248 |
| Triethyl Phosphate | 106 |
| U.S. Peroxygen Catalyst No. 245 | 8 |
| Aluminum Trihydrate | 144 |
| Sand Blend No. 1 | 3620 |

Following the exposure described in Example I, a coated block was produced with a facing that completely failed in resistance to staining but did maintain its ability to resist discoloration (blushing) due to moisture.

While the examples illustrate the use of the water and stain-resistant sand-filled polyesters of the invention as facing layers for masonry blocks, it will be appreciated that they can also be used as cast resins, as such, without being applied to a masonry unit.

What is claimed is:

1. In a cast article of a cured resinous composition of an ethylenically-unsaturated polymerizable polyester resin and sand particles, said sand particles comprising at least about 50% by weight of said composition, and in which said sand particles and cured resin are bonded to one another by a bonding agent comprising an unsaturated silane also having attached to the silicon a group which reacts with the hydroxyl groups present in sand or moisture present in the surface of sand, and wherein the resinous composition also comprises styrene, p-methyl styrene, methyl methacrylate, vinyl acetate, diallyl phthalate, cyclopentadiene or ethyl acrylate as a polymerizable solvent, the improvement comprising employing as the polyester resin, a polyester made from a glycol component consisting of neopentyl glycol, or a mixture of neopentyl glycol, with up to 42 molar percent based on the total glycol of a glycol selected from the group consisting of propylene glycol, ethylene glycol and diethylene glycol, and a component consisting of isophthalic acid and maleic anhydride, the maleic anhydride being 10 to 33% of the total polyester resin by weight, said cast article having improved stain resistance.

2. A cast article according to claim 1 wherein the glycol is neopentyl glycol or a mixture of at least 58 molar percent neopentyl glycol with up to 42 molar percent of propylene glycol.

3. A cast article according to claim 2 wherein the polymerizable solvent is styrene or methyl methacrylate.

4. A cast article according to claim 3 wherein the amount of maleic anhydride is 10 to 30% of the total polyester resin by weight.

5. A cast article according to claim 1 wherein the polymerizable solvent is methyl methacrylate and there is included triethyl phosphate in an amount sufficient to impart fire-retardancy to the composition.

6. In a masonry unit having an integral molded facing layer of a cured resinous composition of an ethylenically-unsaturated polymerizable polyester resin and sand particles, said sand particles comprising at least about 50% by weight of said composition and in which said sand particles and cured resin are bonded to one another by a bonding agent comprising an unsaturated silane also having attached to the silicon a group which reacts with the hydroxyl groups present in sand or moisture present in the surface of sand, and wherein the resinous composition also comprises styrene, p-methyl styrene, methyl methacrylate, vinyl acetate, diallyl phthalate, cyclopentadiene or ethyl acrylate as a polymerizable solvent, the improvement comprising, as the polyester resin, a polyester made from a glycol component consisting of neopentyl glycol or a mixture of neopentyl glycol with up to 42 molar percent based on the total glycol of a glycol selected from the group consisting of propylene glycol, ethylene glycol and diethylene glycol, and a component consisting of isophthalic acid and maleic anhydride, the maleic anhydride being 10 to 33% of the total polyester resin by weight, said masonry unit having improved stain resistance.

7. A masonry unit according to claim 6 wherein the glycol is neopentyl glycol or a mixture of at least 58 molar percent of neopentyl glycol with up to 42 molar percent of propylene glycol.

8. A masonry unit according to claim 7 wherein the maleic anhydride is 10 to 30% of the total polyester resin by weight.

9. A masonry unit according to claim 8 wherein the glycol is neopentyl glycol or a mixture of at least 90 molar percent of neopentyl glycol with up to 10 molar percent of propylene glycol.

10. A masonry unit according to claim 9 wherein the glycol consists of neopentyl glycol.

11. A masonry unit according to claim 7 wherein the polymerizable solvent is styrene or methyl methacrylate.

12. A masonry unit according to claim 11 wherein the polymerizable solvent is styrene.

13. A masonry unit according to claim 12 wherein there is included chlorinated paraffin in the facing composition in an amount sufficient to impart fire-retardancy to the facing composition.

14. A masonry unit according to claim 11 wherein the polymerizable solvent is methyl methacrylate.

15. A masonry unit according to claim 14 wherein there is included triethyl phosphate in the facing composition in an amount sufficient to impart fire-retardancy to the facing composition.

16. A masonry unit according to claim 11 wherein the amount of maleic anhydride is 10 to 30% of the total polyester resin by weight.

17. A masonry unit according to claim 16 wherein the glycol is neopentyl glycol or a mixture of neopentyl glycol with up to 10 molar percent of propylene glycol.

18. A masonry unit according to claim 11 wherein the polyester resin is made from neopentyl glycol, isophthalic acid and maleic anhydride in the molar ratios of about 1:0.5:0.5.

19. A masonry unit according to claim 7 wherein the polymerizable solvent is ethyl acrylate.

20. A masonry unit according to claim 6 wherein the silane has the formula $R_xSiX_{(4-x)}$ wherein at least one R is an unsaturated group and any remaining R groups are unsaturated groups or hydrocarbyl, X is a group which reacts with the hydroxyl groups present in said or moisture present in the surface of sand and $x$ is a whole number from 1 to 3.

21. A masonry unit according to claim 20 wherein at least one R is alkenyl, haloalkenyl or alkadienyl and any remaining R groups are hydrocarbyl.

22. A masonry unit according to claim 21 wherein at least one R is alkenyl, haloalkenyl or alkadienyl and any remaining R groups are alkyl or aryl.

23. A masonry unit according to claim 22 wherein X is chlorine, bromine, oxyaryl, oxyalkyl, amino or oxyethoxymethyl.

24. A masonry unit according to claim 23 wherein X is chlorine, bromine, oxyaryl, oxyalkyl or amino.

25. A masonry unit according to claim 23 wherein X is oxyethoxymethyl.

26. A cast article according to claim 1 wherein the polymerizable solvent is ethyl acrylate.

27. A cast article according to claim 1 wherein the silane has the formula $R_xSiX_{(4-x)}$ wherein at least one R is an unsaturated group and any remaining R groups are unsaturated groups or hydrocarbyl, X is a group which reacts with the hydroxyl groups present in sand or moisture present in the surface of sand and $x$ is a whole number from 1 to 3.

28. A cast article according to claim 27 wherein at least one R is alkenyl, haloalkenyl or alkadienyl and any remaining R groups are hydrocarbyl.

29. A cast article according to claim 28 wherein at least one R is alkenyl, haloalkenyl or alkadienyl and any remaining R groups are alkyl or aryl.

30. A cast article according to claim 29 wherein X is chlorine, bromine, oxyaryl, oxyalkyl, amino or oxyethoxymethyl.

31. A cast article according to claim 30 wherein X is chlorine, bromine, oxyaryl, oxyalkyl or amino.

32. A cast article according to claim 29 wherein X is oxyethoxymethyl.

* * * * *

REEXAMINATION CERTIFICATE (67th)

United States Patent [19]

Sergovic

[11] B1 4,031,289

[45] Certificate Issued Mar. 29, 1983

[54] STAIN RESISTANT POLYESTER-COATED BLOCK

[75] Inventor: John A. Sergovic, Severna Park, Md.

[73] Assignee: The Burns & Russell Company of Baltimore City, Baltimore, Md.

Reexamination Request

No. 90/000,070, Sep. 18, 1981

Reexamination Certificate for:

| | |
|---|---|
| Patent No.: | **4,031,289** |
| Issued: | **Jun. 21, 1977** |
| Appl. No.: | **685,254** |
| Filed: | **May 11, 1976** |

[51] Int. Cl.[3]..... B32B 13/12; B32B 5/16; B32B 27/36

[52] U.S. Cl. ... 428/451; 428/331; 428/404; 428/405; 428/446; 428/447; 428/454; 428/480; 428/482; 428/920; 428/921; 535/451; 52/612; 52/309.3

[58] Field of Search ..... none

[56] References Cited

U.S. PATENT DOCUMENTS

| | | |
|---|---|---|
| 3,328,231 | 6/1967 | Sergovic. |
| 3,632,725 | 1/1972 | Jones. |

OTHER PUBLICATIONS

"Improved UV Resistance of NPG-Based Polyesters", Eastman Chemicals, reprinted from Plastics Technology, vol. 12, No. 2, February 1966.

"Polyester Resins", 1968–1969 Modern Plastics Encyclopedia.

"Preparation of Unsaturated Polyesters Based on NPG® Glycol", Publication No. N-145, Eastman Chemicals, 1970.

"Synthesis of High Molecular Weight, Low Viscosity Polyester Resins From NPG® Glycol For Gel Coat Applications" Publication No. N-194, Eastman Chemicals, August 1974.

"V-33030 White Sanitaryware Gel Coat", Plastic Color Data Sheet No. CDF-81171 by Ferro Corporation, Aug. 11, 1971.

Kirk-Othmer Encyclopedia of Chemical Technology, 2nd Ed., vol. 5, pp. 231–239, John Wiley & Sons (1966).

Kirk-Othmer Encyclopedia of Chemical Technology, Supp. vol., p. 484, John Wiley & Sons (1971).

Kirk-Othmer Encyclopedia of Chemical Technology, 2nd Ed., vol. 20, pp. 830–832, John Wiley & Sons (1969).

Kirk-Othmer Encyclopedia of Chemical Technology, 2nd Ed., vol. 18, pp. 260–268, John Wiley & Sons (1969).

*Primary Examiner*—Ellis Robinson

*Attorney, Agent, or Firm*—Cushman, Darby & Cushman

[57] ABSTRACT

Masonry blocks are provided with a cured resinous coating of an ethylenically-unsaturated polyester. The polyhydric alcohol in the ester is primarily neopentyl glycol to provide water resistance. The acid in the ester is isophthalic acid with 10 to 33% maleic anhydride, based on the total weight of the polyester. If the upper limit on the maleic anhydride is exceeded, stain resistance is lost. Triethyl phosphate is preferably incorporated to provide fire resistance while eliminating flame and smoke problems when employing methyl methacrylate as a polymerizable solvent. The sand-polyester compositions of the invention can also be formed as cast articles without a masonry unit backing.

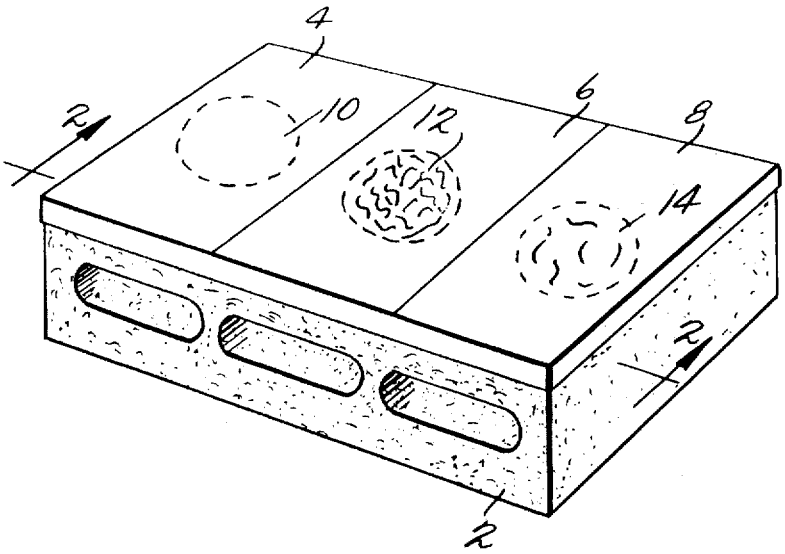

REEXAMINATION CERTIFICATE ISSUED UNDER 35 U.S.C. 307.

THE PATENT IS HEREBY AMENDED AS INDICATED BELOW.

Matter inclosed in heavy brackets appeared in the patent, but has been deleted and is no longer a part of the patent; matter printed in italics indicates additions made to the patent.

AS A RESULT OF REEXAMINATION, IT HAS BEEN DETERMINED THAT:

Claims 3, 5, 11, 12, 14–17, 19, and 26, having been finally determined to be unpatentable, are cancelled.

Claims 1, 4, 6, 13 and 18 are determined to be patentable as amended:

1. In a cast article of a cured resinous composition of an ethylenically-unsaturated polymerizable polyester resin and sand particles, said sand particles comprising at least about 50% by weight of said composition, and in which said sand particles and cured resin are bonded to one another by a bonding agent comprising an unsaturated silane also having attached to the silicon a group which reacts with the hydroxyl groups present in sand or moisture present in the surface of sand, and wherein the resinous composition also comprises styrene [, p-methyl styrene,] *and* methyl methacrylate [vinyl acetate, diallyl phthalate, cyclopentadiene or ethyl acrylate] as a polymerizable solvent, the improvement comprising employing as the polyester resin, a polyester made from a glycol component consisting of neopentyl glycol, or a mixture of neopentyl glycol, with up to 42 molar percent based on the total glycol of a glycol selected from the group consisting of propylene glycol, ethylene glycol and diethylene glycol, and a component consisting of isophthalic acid and maleic anhydride, the maleic anhydride being 10 to 33% of the total polyester resin by weight *and wherein the polymerizable solvent includes triethyl phosphate in an amount sufficient to lower the viscosity and to impart fire-retardance to the composition,* said cast article having *blush resistance and* improved stain resistance *and being suitable for use both for exterior and interior purposes.*

4. A cast article according to claim [3] *2* wherein the amount of maleic anhydride is 10 to 30% of the total polyester resin by weight.

6. In a masonry unit having an integral molded facing layer of a cured resinous composition of an entylenically-unsaturated polymerizable polyester resin and sand particles, said sand particles comprising at least about 50% by weight of said composition and in which said sand particles and cured resin are bonded to one another by a bonding agent comprising an unsaturated silane also having attached to the silicon a group which reacts with the hydroxyl groups present in sand or moisture present in the surface of sand, and wherein the resinous composition also comprises styrene [,p-methyl styrene,] *and* methyl methacrylate [vinyl acetate, dially phthalate, cyclopentadiene or ethyl acrylate] as a polymerizable solvent, the improvement comprising employing as the polyester resin, a polyester made from a glycol component consisting of neopentyl glycol, or a mixture of neopentyl glycol, with up to 42 molar percent based on the total glycol of a glycol selected from the group consisting of propylene glycol, ethylene glycol and diethylene glycol, and a component consisting of isopthalic acid and maleic anhydride, the maleic anhydride being 10 to 33% of the total polyester resin by weight *and wherein the polymerizable solvent includes triethyl phosphate in an amount sufficient to lower the viscosity and to impart fire-retardance to the composition,* said masonry unit having *blush resistance and* improved stain resistance *and being suitable for use both for exterior and interior purposes.*

13. A masonry unit according to claim [12] *7* wherein there is included chlorinated paraffin in the facing composition in an amount sufficient to impart fire-retardancy to the facing composition.

18. A masonry unit according to claim [11] *7* wherein the polyester resin is made from neopentyl glycol, isophthalic acid and maleic anhydride in the molar ratios of about 1:0.5:0.5.

Claims 2, 7–10, 20–25 and 27–32, dependent on amended claims, are determined to be patentable.

New claims 33–64 added and determined to be patentable.

*33. A cast article according to claim 1 including aluminum trihydrate as a filler.*

*34. A cast article according to claim 33 wherein the polyester resin employed has an acid value of 16 to 20.*

*35. A cast article according to claim 1 wherein the polyester resin employed has an acid value of 16 to 20.*

*36. A cast article according to claim 34 wherein the amount of maleic anhydride is 10 to 30% of the total polyester resin by weight.*

*37. A cast article according to claim 33 wherein the amount of maleic anhydride is 10 to 30% of the total polyester resin by weight.*

*38. A cast article according to claim 34 wherein the glycol consists of neopentyl glycol.*

*39. A cast article according to claim 34 wherein the glycol consists of a mixture of neopentyl glycol with propylene glycol, the propylene glycol being present in an amount up to 10 molar percent.*

*40. A masonry unit according to claim 6 including aluminum trihydrate as a filler.*

*41. A masonry unit according to claim 40 wherein the polyester resin employed has an acid value of 16 to 20.*

*42. A masonry unit according to claim 6 wherein the polyester resin employed has an acid value of 16 to 20.*

*43. A masonry unit according to claim 41 wherein the amount of maleic anhydride is 10 to 30% of the total polyester resin by weight.*

*44. A masonry unit according to claim 40 wherein the amount of maleic anhydride is 10 to 30% of the total polyester resin by weight.*

*45. A masonry unit according to claim 41 wherein the glycol consists of neopentyl glycol.*

*46. A masonry unit according to claim 41 wherein the glycol consists of a mixture of neopentyl glycol with propylene glycol, the propylene glycol being present in an amount up to 10 molar percent.*

*47. A masonry unit according to claim 20 where the silane is vinyl-tris(2-methoxyethoxy)silane.*

*48. A masonry unit according to claim 47 including aluminum trihydrate as a filler.*

*49. A masonry unit according to claim 48 wherein the polyester resin employed has an acid value of 16 to 20.*

*50. A masonry unit according to claim 47 wherein the polyester resin employed has an acid value of 16 to 20.*

*51. A masonry unit according to claim 49 wherein the amount of maleic anhydride is 10 to 30% of the total polyester resin by weight.*

*52. A masonry unit according to claim 48 wherein the amount of maleic anhydride is 10 to 30% of the total polyester resin by weight.*

*53. A masonry unit according to claim 49 wherein the amount of maleic anhydride is 10 to 30% of the total polyester resin by weight.*

*54. A masonry unit according to claim 53 wherein the polyester resin is made from neopentyl glycol, isophthalic acid, and maleic anhydride in the molar ratios of about 1:0.5:0.5.*

*55. A masonry unit according to claim 52 wherein the polyester resin is made from neopentyl glycol, isophthalic acid, and maleic anhydride in the molar ratios of about 1:0.5:0.5.*

*56. A masonry unit according to claim 51 wherein the polyester resin is made from neopentyl glycol, isophthalic acid, and maleic anhydride in the molar ratios of about 1:0.5:0.5.*

*57. A masonry unit according to claim 50 wherein the polyester resin is made from neopentyl glycol, isophthalic acid, and maleic anhydride in the molar ratios of about 1:0.5:0.5.*

*58. A masonry unit according to claim 49 wherein the polyester resin is made from neopentyl glycol, isophthalic acid, and maleic anhydride in the molar ratios of about 1:0.5:0.5.*

*59. A masonry unit according to claim 48 wherein the polyester resin is made from neopentyl glycol, isophthalic acid, and maleic anhydride in the molar ratios of about 1:0.5:0.5.*

*60. A masonry unit according to claim 47 wherein the polyester resin is made from neopentyl glycol, isophthalic acid, and maleic anhydride in the molar ratios of about 1:0.5:0.5.*

*61. A masonry unit according to claim 51 wherein the polyester resin is made from neopentyl glycol, isophthalic acid, and maleic anhydride in the molar ratios of about 1:0.5:0.5.*

*62. A masonry unit according to claim 50 wherein the polyester resin is made from neopentyl glycol, isophthalic acid, and maleic anhydride in the molar ratios of about 1:0.5:0.5.*

*63. A cast article according to claim 1 wherein the triethyl phosphate based on the total of polyester resin, styrene, methyl methacrylate and triethyl phosphate is 106 parts per total of 920.6 parts.*

*64. A masonry unit according to claim 6 wherein the triethyl phosphate based on the total of polyester resin, styrene, methyl methacrylate and triethyl phosphate is 106 parts per total of 920.6 parts.*

* * * * *